United States Patent [19]

Gonzalvo

[11] 4,370,771

[45] Feb. 1, 1983

[54] WATER-DRIVEN BRUSH

[76] Inventor: Sulpicio A. Gonzalvo, 18772 Eisenhower Cir., Salinas, Calif. 93906

[21] Appl. No.: 204,640

[22] Filed: Nov. 6, 1980

[51] Int. Cl.[3] ..... A46B 13/06

[52] U.S. Cl. ..... 15/29

[58] Field of Search ..... 15/24, 29, 97 R; 173/168, 169

[56] References Cited

U.S. PATENT DOCUMENTS

| | | | |
|---|---|---|---|
| 2,172,195 | 9/1939 | Elson | 15/24 X |
| 2,599,911 | 6/1952 | Haines | 15/29 |
| 3,909,867 | 10/1975 | Hogsell | 15/24 |
| 4,207,640 | 6/1980 | Sekula | 15/29 |

FOREIGN PATENT DOCUMENTS

| | | | |
|---|---|---|---|
| 2216508 | 10/1973 | Fed. Rep. of Germany | 15/29 |
| 595876 | 10/1925 | France | 15/29 |
| 1253079 | 12/1960 | France | 15/29 |
| 361489 | 5/1962 | Switzerland | 15/29 |

*Primary Examiner*—Edward L. Roberts

*Attorney, Agent, or Firm*—Paul B. Fihe

[57] ABSTRACT

The invention provides a water-driven brush in the form of a hand-held unit having a water inlet that can be connected to a sink faucet to provide a power source for a rotary brush that can be used for scrubbing plates or pots in the sink. A portion of the water is deflected onto the brush to facilitate the operation and the major water discharge through a main outlet can be used for rinsing the plates or pots.

1 Claim, 3 Drawing Figures

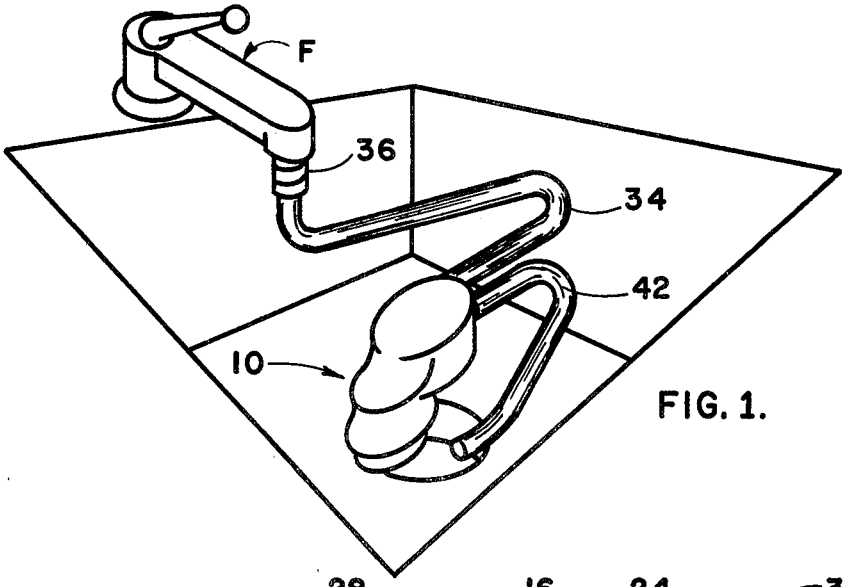
FIG. 1.
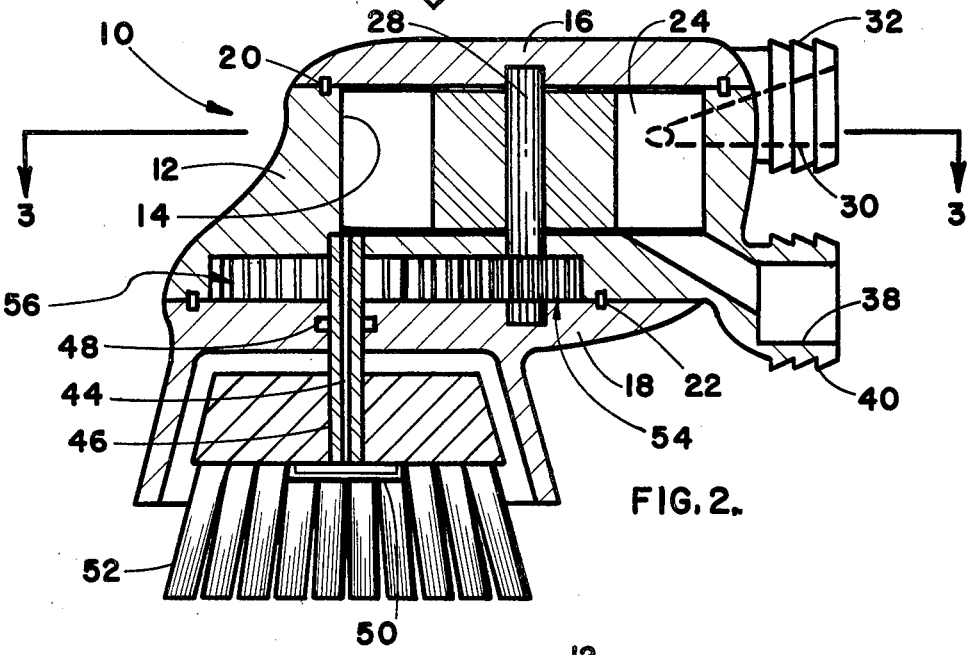
FIG. 2.
FIG. 3.
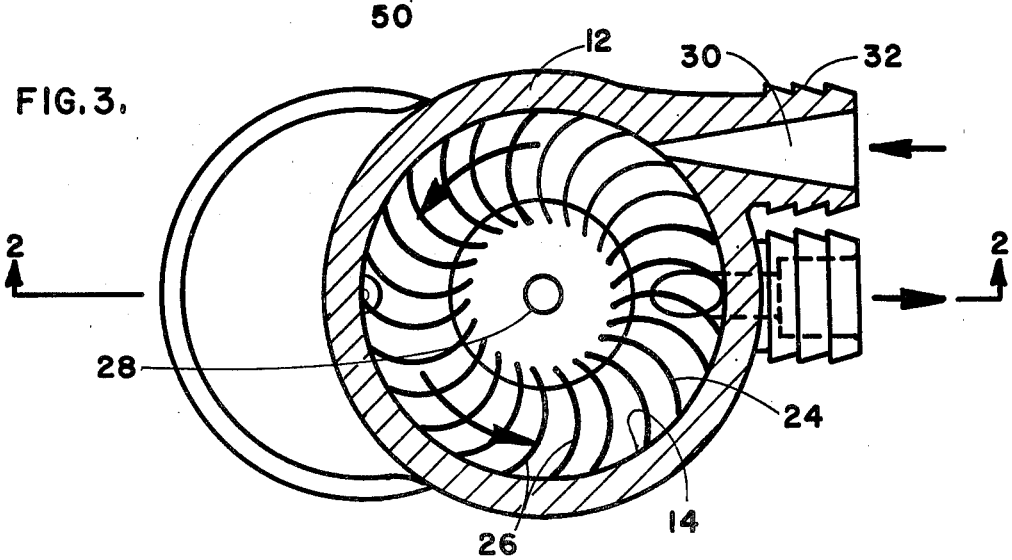

WATER-DRIVEN BRUSH

FIELD OF THE INVENTION

The present invention relates generally to cleaning implements, and more particularly to a water-driven brush which facilitates the scrubbing and cleaning of dishes, pots and pans or the like.

BACKGROUND OF THE INVENTION

A number of rotary water-driven brushes have been developed as cleaning implements for dish washing, car washing and other analogous cleaning activities requiring scrubbing and rinsing operations. Most commonly the same fluid (i.e. water) utilized to drive the rotary brush or other tool is also dispensed onto the scrubbed surface. A dilemma arises however since a full flow of water is required to produce maximum torque of the rotary brush but such full flow is excessive for the dispensation of water onto the scrubbed surface, and the best solution has been a somewhat unsatisfactory compromise.

This problem plus the general complexity, relatively high cost and operational inefficiency of the existing units has limited their use.

SUMMARY OF THE PRESENT INVENTION

Accordingly, it is the general objective of the present invention to provide a water-driven brush which although relatively simple and inexpensive provides maximal application of torque to the rotary brush but a controlled and effective dispensing of the water into the brush area.

Briefly, such objective is achieved by a brush composed of bristles mounted in a generally annular formation at the end of a hollow shaft through which water from the side of a cylindrical chamber adjacent one edge thereof is discharged centrally of the bristles. Preferably, a deflector dispenses water delivered from the exit end of the hollow shaft outwardly into contact with all of the bristles. A turbine is mounted within the cylindrical chamber and its supporting shaft is connected to the hollow brush-supporting shaft by meshing speed-reducing gears which not only provide a speed-reduction and consequent mechanical advantage but also permit a lateral disposition of the hollow shaft to place its inner end adjacent the edge of the turbine chamber.

A water inlet port of convergent inward configuration connects a flexible conduit which in turn is releasably connected to a standard sink faucet to the interior of the turbine chamber substantially in a tangential disposition so that inflowing water will engage and drive the turbine and thereafter be primarily discharged through a main outlet port into a flexible outlet conduit into the sink drain or onto a dish or pot when simple rinsing thereof is desired.

In accordance with the present invention, the outlet port is positioned almost 360 degrees from the inlet port in the direction of turbine rotation, thus to maximize the generation of torque. The convergence of the inlet port also increases the speed of flow and the resultant transfer of power to the turbine.

The described hollow shaft provides a smaller and second outlet port and is positioned intermediate the inlet port and the main outlet port. Since it receives, because of its smaller dimensions, only a small part of the flowing water, not only is substantially the full flow of water available to drive the turbine, but a maximal flow can be introduced into the chamber without providing excessive discharge through the hollow shaft onto the brush.

The entire unit constitutes a simple and readily assembled housing which can be manually grasped and used effectively in the scrubbing and rinsing functions and furthermore is easily attached to a standard faucet for utilization.

BRIEF DESCRIPTION OF THE DRAWING

The stated objective of the invention and the manner in which it is achieved, as summarized hereinabove, will be more readily understood by reference to the following detailed description of the exemplary embodiment of the invention shown in the accompanying drawing wherein;

FIG. 1 is a perspective view of a water-driven brush embodying the invention and shown in its operative location in a kitchen sink, FIG. 2 is an enlarged central sectional view taken along line 2—2 of FIG. 3 showing interior details of the unit, and FIG. 3 is a transverse sectional view of the unit as viewed along line 3—3 of FIG. 2.

DETAILED DESCRIPTION OF THE EXEMPLARY EMBODIMENT OF THE INVENTION

With particular reference to FIG. 2, the water-driven brush constituting an exemplary embodiment of the invention includes a small housing 10 that can be held in the hand and preferably is formed by three elements, a central body member 12 having a cylindrical chamber 14 formed centrally therein which chamber is in turn closed by face plates 16, 18 which are suitably attached to either side of the body member and incorporate annular seals 20, 22 so that the cylindrical chamber is water tight.

A turbine 24 having a plurality of vanes 26 extending radially from a central shaft 28 and preferably with rearward curvature is supported within the cylindrical chamber 14 for rotation, the ends of the shaft being loosely received in aligned recesses in the two face plates 16, 18. A water inlet port 30 formed in the body member 12 is arranged to converge inwardly and communicate with the chamber 14 terminating in a tangential position, the outer portion of the port being formed with a serrated cylindrical stub 32 that can receive the end of a length of flexible tubing 34 composed of rubber, plastic or other materials whose opposite extremity mounts a standard coupler 36 that can be releasably connected over the end of a conventional faucet F as shown in FIG. 1.

The body member also includes a main water outlet port 38 formed in the central body member 12 at a position slightly less than 360 degrees from the inlet port 30 and also includes a cylindrical stub 40 that is serrated to receive the end of another length of flexible tubing 42 whose opposite extremity can be positioned wherever desired, for example near the drain opening in the sink as shown in FIG. 1.

When the faucet valve is opened, water will accordingly flow through the tubing 34 and the inlet port 30 into the central chamber 14 thus driving the turbine 24 in a counter-clockwise direction as shown in FIG. 3 to eventually educt through the outlet port 38 and then the outlet tubing 42. Such water can be used, if desired, to rinse a plate or pot in a convenient fashion since it can be moved to any desired disposition by the user.

A second and smaller water outlet port 44 is formed adjacent the edge of the chamber 14 within a hollow shaft 46 that is mounted on simple bearings 48 in the lower face plate 18 as viewed in FIG. 2 at a position intermediate the main inlet and outlet ports 30, 38, previously described, and will accordingly deliver a small amount of water through the shaft 46 and against a central deflector plate 50 onto a brush 52 including a plurality of downwardly projecting an annularly disposed bristles which rotate with the described hollow shaft.

In order to drive the brush, the turbine shaft 28 mounts at its lower end in a recess in the body member 12 a small gear 54 which in turn meshes with a second larger gear 56 keyed to the hollow shaft 46 so that as the turbine 24 is driven by the water, the shaft will be rotated at a slower speed because of the gear reduction and can accordingly be held against a plate or pot to effect scrubbing action thereon.

Since the inlet port 30 converges inwardly, the rate of flow of water is increased during its passage therethrough, thus to impart a high rate of speed to the turbine 24 and accordingly a substantial amount of torque can be applied to the brush 52 particularly in view of the mechanical advantage provided by the gears. Furthermore, since only a small portion of the water is discharged through the hollow shaft 46, a full flow of water from the faucet F is allowed to impart maximum torque to the turbine and ultimately to the brush while at the same time delivering but a relatively small amount of water into the area of the brush scrubbing to avoid excessive splashing. Thus maximum power can be imparted without excessive dispensing of water into the scrubbing area.

The foregoing description of one embodiment of the invention is to be considered as purely exemplary and those skilled in the art will understand that various modifications and/or alterations can be made in the specific structure described without departing from the spirit of the invention and the foregoing description is accordingly not to be considered as limiting and the actual scope of the invention is to be indicated only by reference to the impended claims.

What is claimed is:

1. A water-driven brush which comprises a housing forming an interior cylindrical chamber, a turbine mounted for rotation in said chamber, a water inlet port adapted to discharge water tangentially into said housing against said turbine to effect rotation thereof, a main discharge outlet port extending from said chamber at a position spaced angularly from said water inlet port only slightly less than 360 degrees, a second smaller outlet port extending from said chamber in a hollow rotary shaft connected to said turbine by gearing so that it is positioned adjacent the edge of said chamber, and a rotary brush member on said hollow rotary shaft surrounding said second outlet port and operatively connected to said turbine.

* * * * *